US006595462B2

(12) United States Patent
Lenski et al.

(10) Patent No.: US 6,595,462 B2
(45) Date of Patent: Jul. 22, 2003

(54) METHOD AND DEVICE FOR MEASURING MULTIPLE STRANDS OF MATERIAL DOSPENSED FORM A SINGLE SPOOL

(76) Inventors: La Rhonda A. Lenski, 2403 E. 73rd Ave., Merrillville, IN (US) 46410; William E Webb, 11241 Chattsworth Rd., Midland, GA (US) 31820; Gary Miller, 28 Pine Grove Ave., Glenburn, ME (US) 04401

( * ) Notice: Subject to any disclaimer, the term of this patent is extended or adjusted under 35 U.S.C. 154(b) by 126 days.

(21) Appl. No.: 09/745,817

(22) Filed: Dec. 21, 2000

(65) Prior Publication Data

US 2001/0030258 A1 Oct. 18, 2001

Related U.S. Application Data

(60) Provisional application No. 60/174,799, filed on Jan. 6, 2000.

(51) Int. Cl.[7] ..... B65H 16/02

(52) U.S. Cl. ..... 242/563.2; 242/566; 242/594.3; 242/594.4; 242/157 R

(58) Field of Search ..... 242/563.2, 566, 242/594.3, 594.4, 157 R

(56) References Cited

U.S. PATENT DOCUMENTS

| | | | | |
|---|---|---|---|---|
| 1,962,028 | A | 6/1934 | Murphy et al. | 73/51 |
| 2,107,616 | A | 2/1938 | Nanjundayya | 73/51 |
| 3,167,865 | A | 2/1965 | Steinberg | 33/127 |
| 3,398,454 | A | 8/1968 | Steinberg | 33/132 |
| 5,833,154 | A | 11/1998 | Kaneko | 242/223 |
| 5,935,499 | A | 8/1999 | Hughes et al. | 264/210.8 |
| 5,970,700 | A | 10/1999 | Scheerer et al. | 57/315 |

*Primary Examiner*—Donald P. Walsh
*Assistant Examiner*—Jonathan R. Miller
(74) *Attorney, Agent, or Firm*—Kyle S. Brant

(57) ABSTRACT

A device and method for dispensing and measuring a plurality of strands from a single spool of stranded material is disclosed. The device is comprised of a mobile portion on which a plurality of pulleys is mounted. The mobile portion includes a frame mounted on an axle to which tires are attached so that the mobile portion may be wheeled about readily. A stationary portion includes a plurality of pulleys and a supply spool of wire. Stranded material from the supply spool is routed back and forth between the mobile portion and the stationary portion, over the pulleys attached to each, until the number of strands between the mobile portion and the stationary portion corresponds with the desired number. Next the mobile portion is displaced away from the stationary portion a distance equal to the length of strands desired. A distance measurement device is mounted on the mobile portion to aid the user in ascertaining the distance that the mobile portion has moved, thereby indicating the wire length. Another embodiment of the invention includes open-faced pulleys that facilitate more rapid routing of the wires over the pulleys during use thereof.

17 Claims, 7 Drawing Sheets

METHOD AND DEVICE FOR MEASURING MULTIPLE STRANDS OF MATERIAL DOSPENSED FORM A SINGLE SPOOL

This appln claims benefit of provisional application No. 60/174,799 filed Jan. 6, 2000.

FIELD OF THE INVENTION

This invention relates in general to devices for dispensing material stored on spools and more specifically to a device for dispensing and accurately measuring multiple strands of wire from stock stored on a single spool.

BACKGROUND OF THE INVENTION

Electricians charged with the task of wiring sophisticated electrical systems in buildings wherein multiple extended lengths of insulated wire are needed typically use a vertical rack system to aid in dispensing the wire from spool stocks mounted on horizontal rods in the rack. In such a system, where multiple strands of wire of equal length are needed, the electrician will mount a quantity of spools on the rack with the number of spools corresponding to the number or quantity of wires needed. Then, a strand of wire from each spool is simultaneously pulled from each spool to a desired length and cut. If the quantity of wires needed is in excess of the spool mounting capacity of the rack or the number of spools of wire available to the electrician, then multiple "pulling and cutting" operations are required to obtain the desired quantity of elongated equal lengths of wire. Where the length of wire needed is significant, such as 20 feet or more as in the wiring of a commercial facility, an electrician or technician must perform multiple wire "pulling and cutting" operations. The prior art does not provide any convenient device or method for accurately dispensing multiple strands of wire other than requiring a spool of wire for each strand desired when dispensing the wire. What is needed is a method and device for accurately measuring and dispensing multiple strands of wire from a single spool of wire.

SUMMARY OF THE INVENTION

A device for measuring and dispensing multiple elongated lengths of wire at a desired wire length from a single supply spool of wire, according to one aspect of the present invention, comprises a stationary member, a first plurality of pulleys rotatably attached to said stationary member, a supply spool rotatably attached to said stationary member, said supply spool having a wire wound thereon, a mobile member, a second plurality of pulleys rotatably attached to said mobile member, and wherein said wire on said supply spool is looped once about each of said second plurality of pulleys on said mobile member, and about each of said first plurality of pulleys on said stationary member in an alternating fashion in accordance with the number of elongated lengths of wire desired, and wherein said mobile member is displaced from said stationary member a distance equal to the desired wire length and said wires are cut from said first and second plurality of pulleys.

One object of the present invention is to provide an improved device for measuring and dispensing desired lengths of wire.

Another object of the present invention is to provide a device that enables the measuring and cutting of multiple equal lengths of wire from a single spool of wire in one operation.

Still another object of the present invention is to reduce the time and difficulty encountered when multiple long lengths of wire are needed for an electrical wiring project.

These and other object of the present invention will become more apparent from the following description of the preferred embodiments and accompanying figures.

DESCRIPTION OF THE PREFERRED EMBODIMENTS

Figure 1:
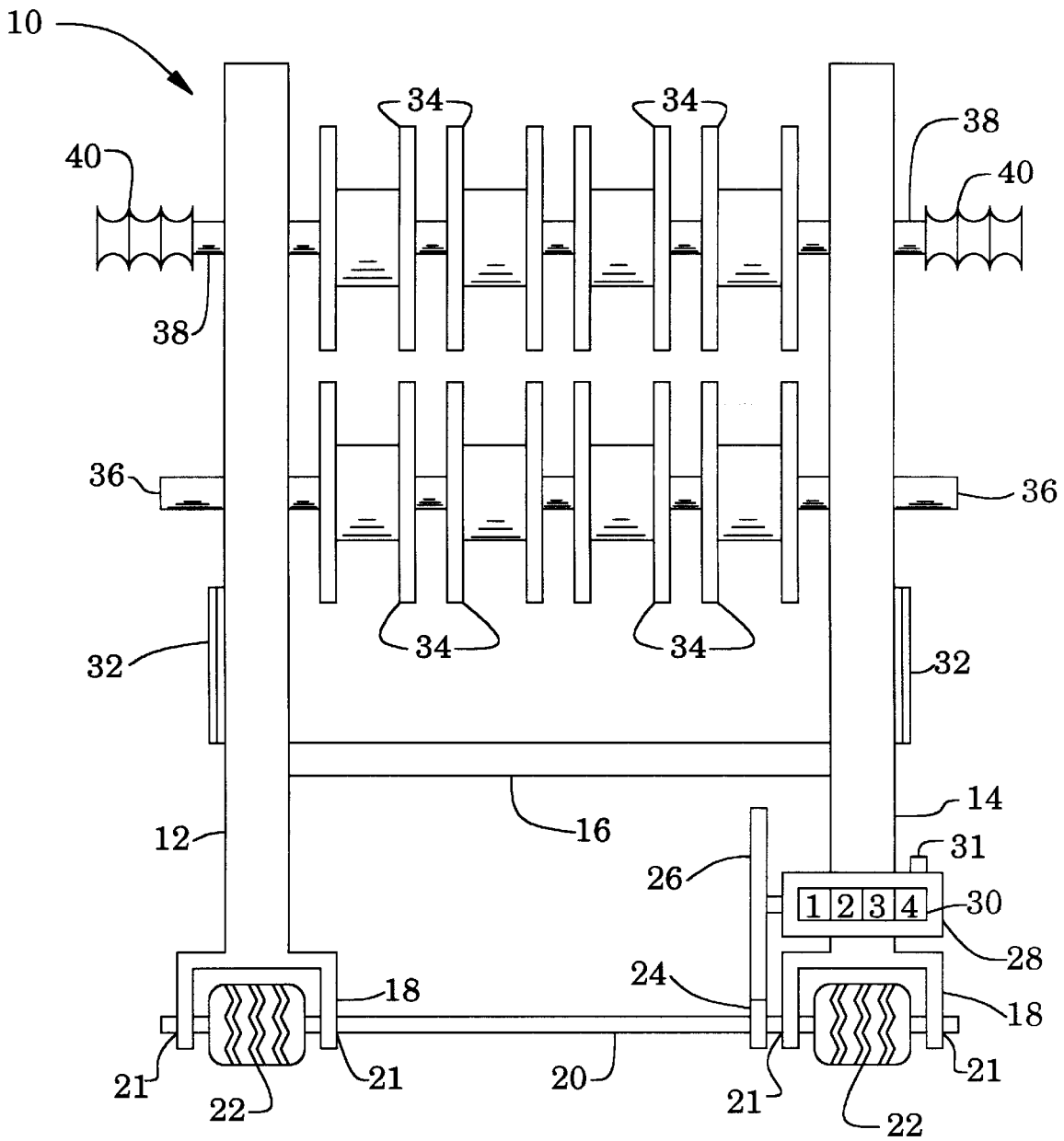
FIG. 1 is a front elevational view of a mobile portion of a device for measuring multiple strands of material dispensed from a single spool.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a mobile portion 10 of the device for measuring multiple strands of material dispensed from a single spool, according to one aspect of the present invention, is shown. Mobile portion 10 includes upright members 12 and 14. A horizontal brace 16 is attached to both upright members 12 and 14 to provide structural support for the mobile portion 10. At the lower end of upright members 12 and 14 are inverted U-channels 18 formed therein. Axle 20 is inserted through apertures at locations 21 in U-channels 18. Axle 20 is inserted through U-channels 18 and tires 22 are positioned to receive axle 20 therethrough so that tires 22 are captured within U-channels 18 as shown. At least on of tires 22 are fixedly attached to axle 20 so that as tires 22 rotate, axle 20 rotates in accordance therewith. Axle 20 is rotationally mounted to and retained within U-channels 18 via any mechanism well known in the art, including c-clips, cotter pins, clamps with set screws and the like. Gear 24, mounted on axle 20 and rotating in accordance with the rotation of axle 20, engages gear 26. Gear 26 is attached to shaft extending from rotational counter device 28. Counter device 28 is a mechanical or electronic rotational counter and includes a numerical display 30. Counter device 28 includes a reset button 31 that resets or zeroes display 30 when depressed. Numerical display 30 indicates visually to the user the rotary displacement of gear 26. The gear ratio for gears 26 and 24 is selected to provide meaningful measurement data on display 30. Hinged braces (shown in more detail in FIG. 2) are shown in their "folded-up" position. Pulleys 34 are rotatably mounted on rods 36 and 38. Rods 36 and 38 extend between upright members 12 and 14 to provide support for pulleys 34. Pulleys 34 optionally include sleeve or ball bearings (not shown) to reduce rotational frictional forces that develop between pulleys 34 and rods 36 and 38 as pulleys 34 are rotated. Handles grips 40 are installed on the distal ends of rod 38 to provide a convenient location for the user to grasp and move mobile portion 10.

Figure 2:
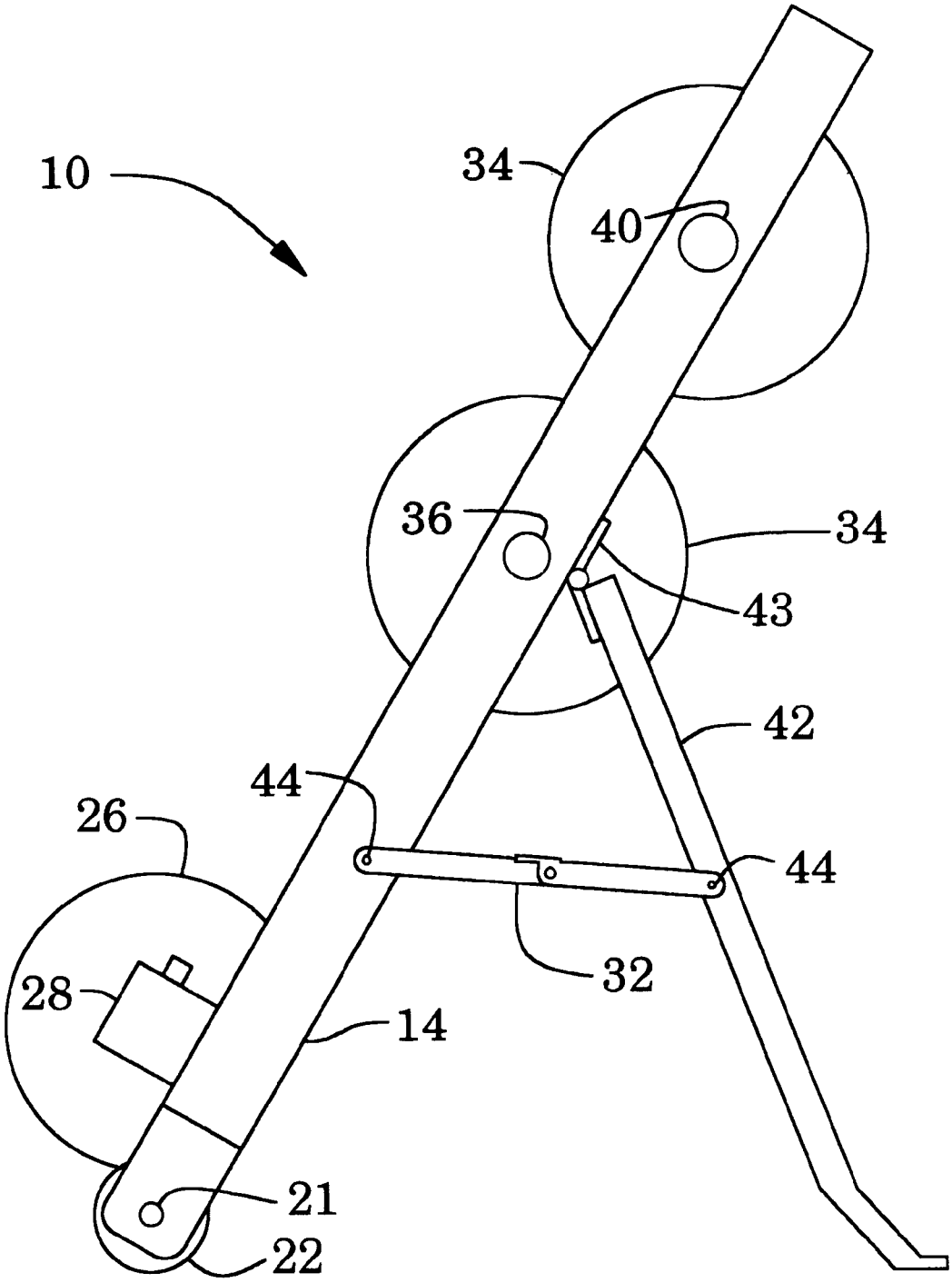
FIG. 2 is a side elevational view of the vertical frame shown in FIG. 1.

Referring now to FIG. 2, a side elevational view of mobile portion 10 is shown in an inclined resting position. Support legs 42 (of which mobile portion 10 includes two such legs that are identical) extend rearwardly from upright members 12 and 14. In this particular view, only one of the support legs 42 is visible. Legs 42 are attached to hinges 43. Hinges 43 are also attached as shown to upright members 12 and 14. Hinged braces 32 are pivotally attached at their distal ends to upright members 12 and 14 and legs 42 at locations 44. Hinged braces 32 establish a fixed distance that legs 42 are extended or displaced from upright members 12 and 14 so that the free end of leg 42 may rest upon the ground surface. Legs 42, braces 32 and hinges 43 provide a convenient mechanism for supporting mobile portion 10 in a substantially upright position when mobile portion 10 is at rest. Also shown in FIG. 2 are pulleys 34, gear 26, counter device 28, tire 22 and axle 21.

Figure 3:
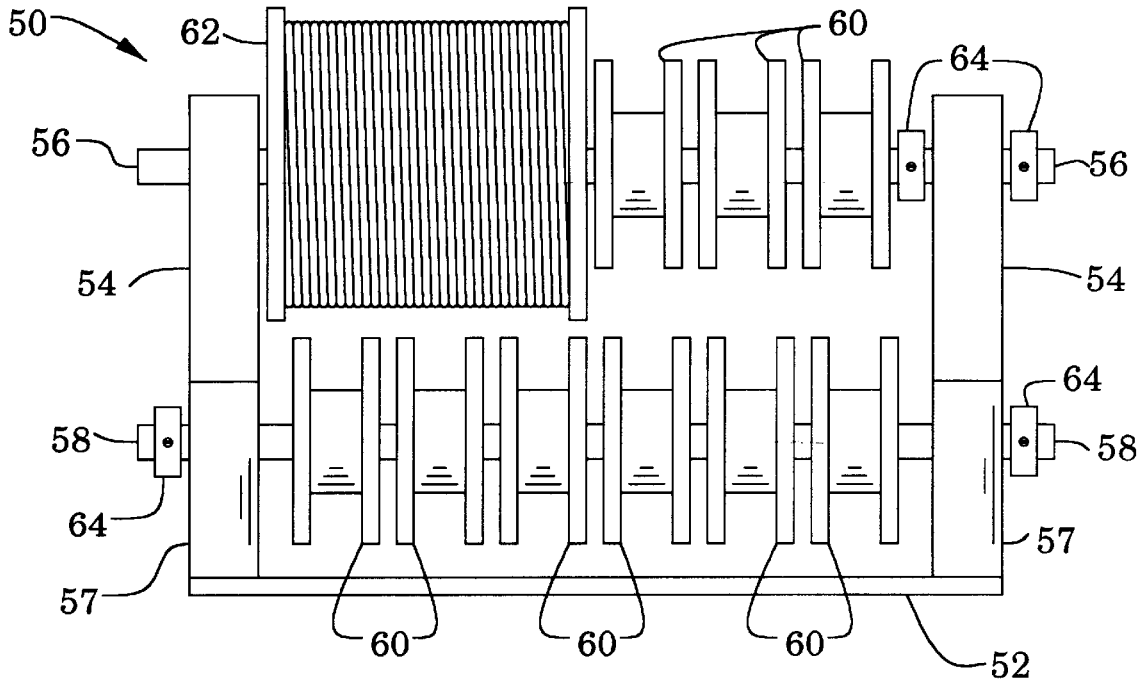
FIG. 3 is a front elevational view of a stationary portion of the device for measuring multiple strands of material dispensed from a single spool.
Figure 4:
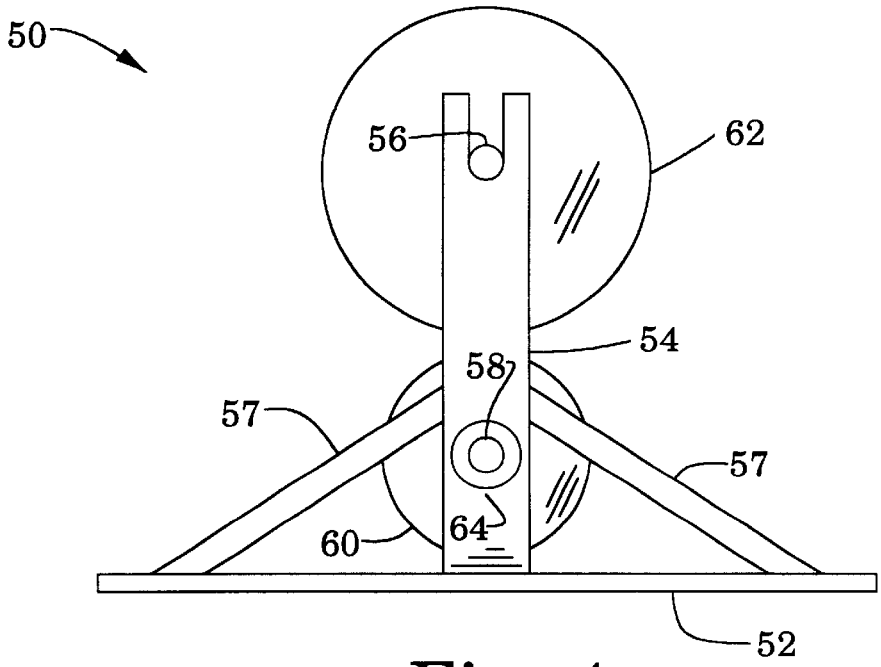
FIG. 4 is a side view of the stationary portion shown in FIG. 3.

Referring now to FIGS. 3 and 4, front and side elevational views of a stationary portion 50 of the device for measuring multiple strands of material dispensed from a single spool, according to the present invention, are shown. Stationary portion 50 includes a base 52 and two vertical braces 54 attached to and extending upward from base 52. Angled braces 57 are attached to vertical braces 54 and base 52 to provide added support and rigidity to the structure of stationary portion 50. Rods 56 and 58 extend across and through vertical braces 54. Mounted on rods 56 and 58 are pulleys 60 and a spool 62 of stranded material, such as insulated wire. Clamps 64 are attached to rods 56 and 58 to secure the rods in position with respect to vertical braces 54. Pulleys 60 rotate freely on rods 56 and 58. Spool 62 also rotates freely on rod 56.

Upright members or braces 12, 14, legs 42, hinged brace 32, base 52, vertical brace 54, and angled brace 57 are constructed of high strength materials such as steel, reinforced plastics, fiberglass or suitable high strength materials. Rods 36 and 38, axle 20, rod 58 and rod 56 are made of durable materials such as metal, steel, plastics such as nylon or the like, or suitable substitutes therefor. Tires 22 are rubber or plastic composite material, though metal is also contemplated. Pulleys 34 and 60 are metal, wood, plastic, or any suitable substitute material. Clamps 64 are made of metal or plastic.

Figure 5:
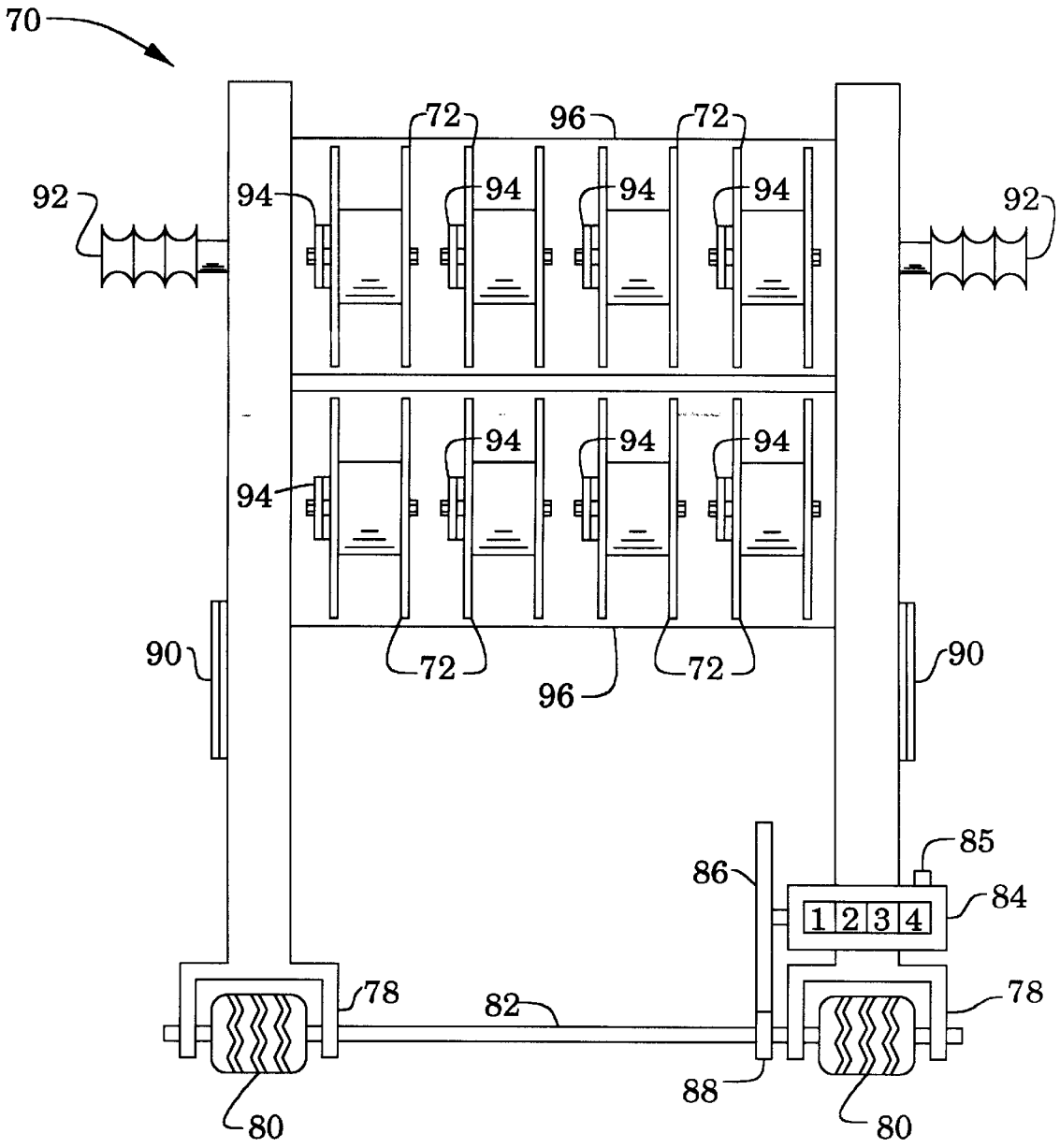
FIG. 5 is a front elevational view of another mobile portion of a device for measuring multiple strands of material dispensed from a single spool.
Figure 6:
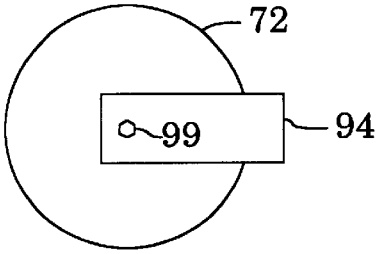
FIG. 6 is a right side elevational view of the pulley and bracket assembly shown in FIG. 5.
Figure 7:
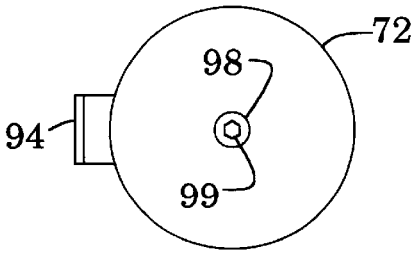
FIG. 7 is a is a left side elevational view of the pulley and bracket assembly shown in FIG. 5.
Figure 8:
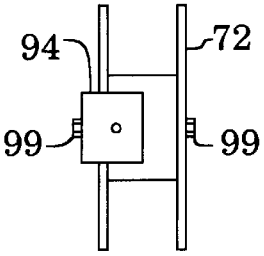
FIG. 8 is a rear elevational view of the pulley and bracket assembly shown in FIG. 5.
Figure 9:
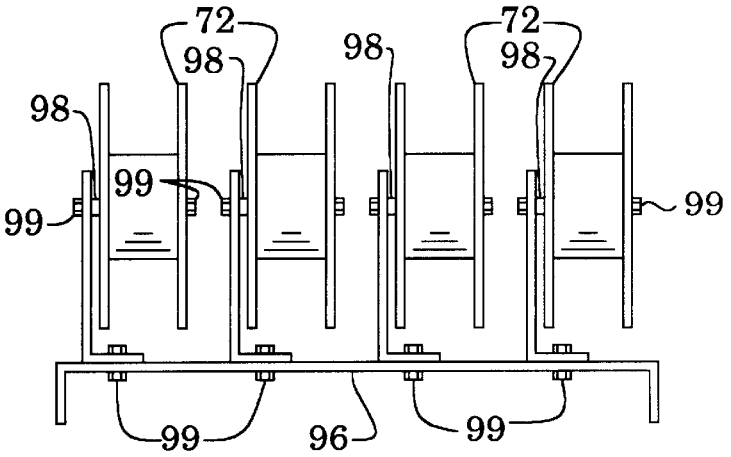
FIG. 9 is a plan view of a pulley array shown in FIG. 5.
Figure 10:
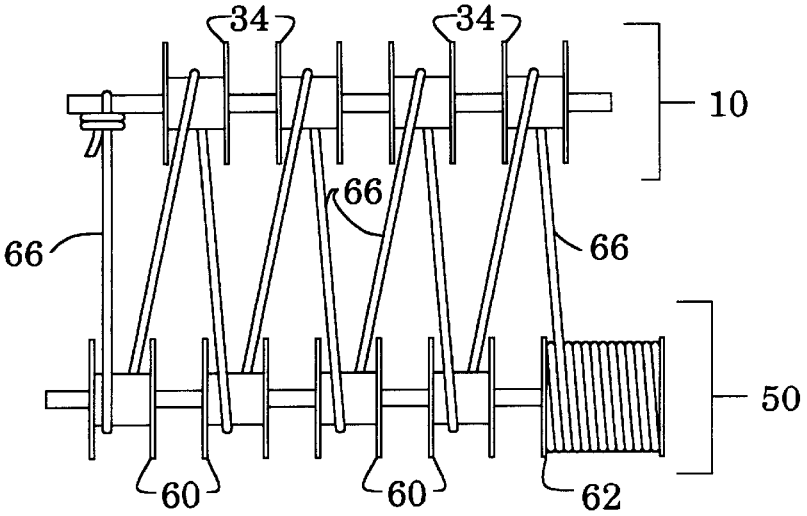
FIG. 10 is a diagrammatic illustration of the operation of the device for measuring multiple strands of material dispensed from a single spool.

Operationally speaking, the embodiment of the invention including mobile portion 10 and stationary portion 50 is used in accordance with the diagrammatic illustration shown in FIG. 10. Mobile portion 10 is positioned close to stationary portion 50 as shown in FIG. 10. Wire 66 from spool 62 is drawn out and routed over pulleys 34 and 60 as shown until the desired number of strands extend between mobile portion 10 and stationary portion 50. Wire 66 is then secured either to mobile portion 10 or stationary portion 50, according to the number of strands of wire desired. At this point, the reset button of counter device 28 is depressed to reset the display 30 to zero. Next, mobile portion 10 is displaced away from stationary portion 50 by the user in accordance with the visual information provided on display 30 (which corresponds preferably to distance in inches, feet or meters). When display 30 indicates the appropriate separation distance is achieved between mobile portion 10 and stationary portion 50, the user extends the hinged legs 42 of mobile portion 10 and leans mobile portion 10 to rest on legs 42 and tires 22. Next, the user cuts the wires extending between mobile portion 10 and stationary portion 50 near each corresponding pulley and each wire will be of the desired length. Referring now to FIG. 5, another embodiment of a mobile portion 70 comprising a part of a device for measuring multiple strands of material, according to the present invention, is shown. Mobile portion 70 is comprised of substantially the same features and provides the same functionality as mobile portion 10, with the primary difference being the mounting configuration of pulleys 72 thereon. Mobile portion 70 includes upright members 74 and 76 that are identical in features with members 12 and 14 of FIG. 1. At the lower end of upright members 74 and 76 are inverted U-channels 78 formed therein. U-channels 78 provide an aperture within which tires 80 are disposed. At least one of tires 80 is fixedly mounted to axle 82, and the other tire may rotate freely on the axle. Rotational counter device 84 provides visual feedback to the user concerning the rotational motion of gear 86. Gear 86 is rotated in accordance with gear 88 as axle 82 turns in response to the rotation of tires 80. Thus, device 84 provides a visual indication of the rotation of tires 80. Reset button 85 provides a mechanism to reset the displayed value on device 84 to zero. The selection of gear ratios for gears 86 and 88 in accordance with the functional parameters of device 84 combine to produce a display value on device 84 corresponding to displacement in units of length (such as feet, inches or meters) in response to the rotation of axle 82 by tires 80. Hinged braces 90 (identical to those shown in FIG. 2) attach to support legs (not shown) mounted on the rear surfaces of upright members 74 and 76 that are physically and functionally identical to legs 42 shown in FIG. 2. Handles 92 are attached to upright members 74 and 76 to provide a convenient mechanism for the user to grasp mobile portion 70 and move or displace mobile portion 70 on tires 80. Pulleys 72 are rotatably mounted on mounting brackets 94. Mounting brackets 94 are attached to mounting plates 96. Mounting plates 96 are attached to upright members 74 and 76 and provide structural stability therebetween.

Referring now to FIGS. 6–9, further detail of the pulleys 72 and associated mounting brackets 94 and mounting plate 96 is shown. Pulleys 72 are rotatably mounted on shaft 98. It is contemplated that ball, roller or sleeve bearings are optionally used in mounting pulleys 72 on shafts 98 to reduce frictional forces. Nuts and bolts 99 attach brackets 94 to mounting plate 96 and retain pulleys 72 on shafts 98. Welds or adhesives may be used as substitutes for nuts and bolts 99, as is well known in the art. Further, c-clips, sleeve clamps and the like may be used to attach pulleys 72 to shafts 98.

Figure 12:
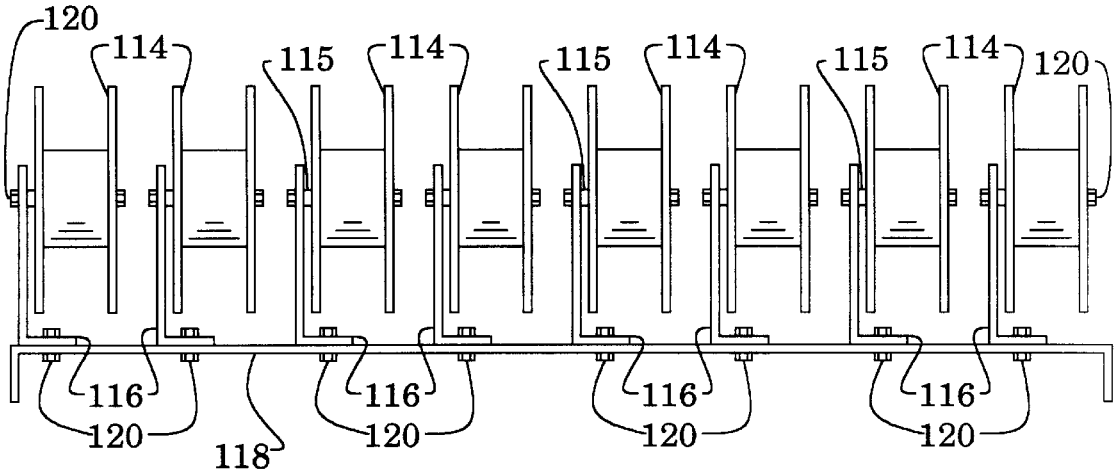
FIG. 12 is a top elevational view of the bracket and pulleys attached thereto shown in FIG. 11.
Figure 11:
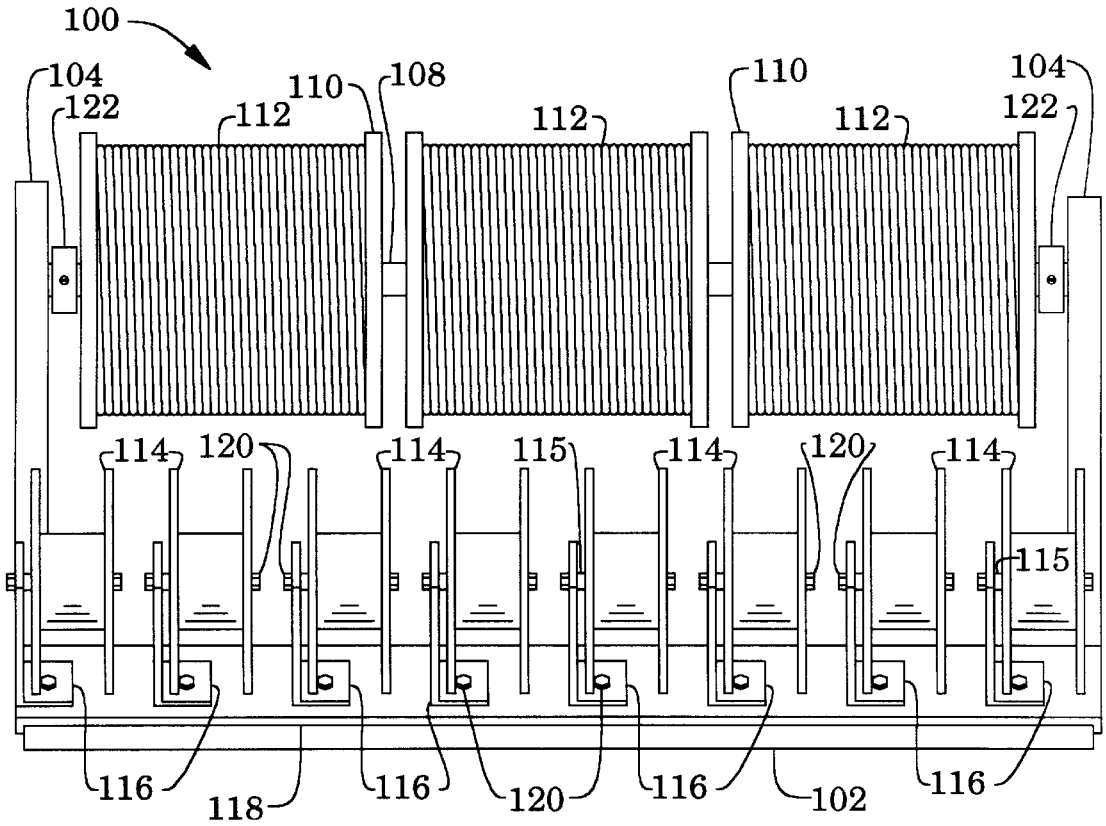
FIG. 11 is a front elevational view of another stationary portion of the device for measuring multiple strands of material dispensed from a single spool.
Figure 13:
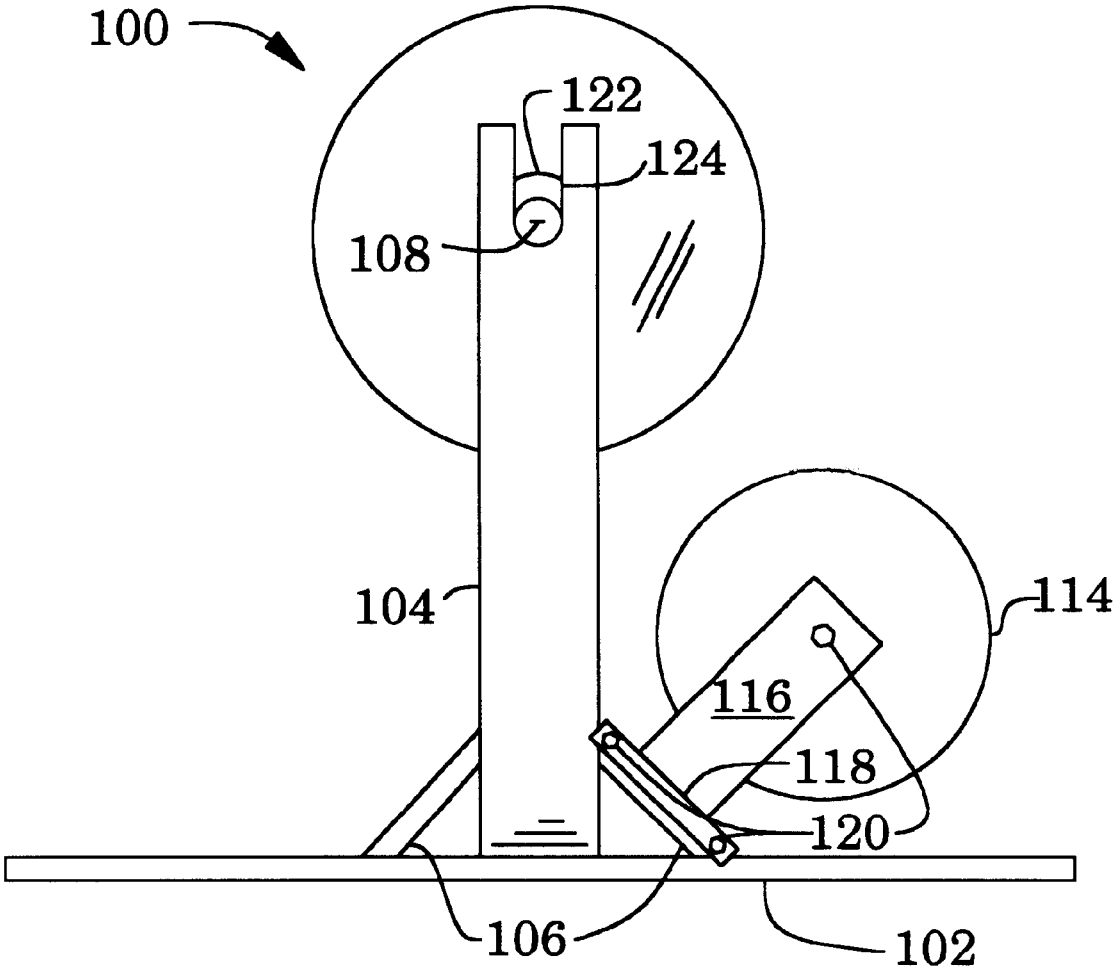
FIG. 13 is a side elevational view of the stationary portion shown in FIG. 11.

Referring now to FIGS. 11, 12 and 13, a stationary portion 100, according to another aspect of the present invention, is shown. Stationary portion 100 includes a base 102, vertical braces 104, angled braces 106, rod 108, supply spools 110 having wire 112 wound thereon, and an array of pulleys 114. Pulleys 114 (identical to pulleys 72) are mounted on brackets 116 that are identical to brackets 94. Each pulley 114, shaft 115 and bracket 116 assembly is identical in form and function to those shown in FIGS. 6–8. An array of bracket/pulley assemblies is attached as shown to mounting plate 118. Nuts and bolts indicated at 120 are employed to attach various components to one another as is shown in the FIGS. 11–13. Clamps 122 retain rod 108 in the channel 124 atop vertical braces 104.

The materials required for construction of the embodiment shown in FIGS. 5 and 11–13 are the same as for the embodiment of FIGS. 1–4. Brackets, braces and mounting plates are preferably constructed from steel or other suitable high strength materials.

Operationally speaking, mobile portion 70 substitutes for mobile portion 10 in the diagrammatic illustration of FIG. 10, and stationary portion 100 substitutes for stationary portion 50 in FIG. 10. The primary advantage of the embodiment shown in FIG. 5 and FIGS. 11–13 becomes more apparent when one routes a wire over the pulleys of the embodiment in preparation for dispensing, measuring and cutting such wire. In the embodiment of FIGS. 1–4, the end of the wire must be routed around pulleys 34 and 60 whereas in the embodiment of FIGS. 5 and 12, one need only loop the wire over the open face of pulleys 72 and 114 for the wire to engage the pulley, thereby providing a more convenient method of using the invention.

The stationary portion 100 shown in FIG. 11 includes multiple supply spools of wire 110 that are contemplated as needed when the length of wire on a supply spool is not sufficient to provide all of the lengths of wire needed of a particular length. For example, if a supply spool of wire 110 includes wire that is only 100 feet in length, and the user desires 6 lengths of wire that are 50 foot in length, then a wire from each of the second and third spools 110 is used to create six strands of wire between the mobile portion 70 and the stationary portion 100 prior to displacing the mobile portion fifty feet away from the stationary portion 100. In this example, a wire is looped about one of the pulleys 72 from each of the three supply spools 110 on mobile portion 70 and then secured to the stationary portion (about vertical brace 104 for example). Then, mobile portion 70 is displaced away from stationary portion 100 and the six desired lengths of wire are dispensed. The user need only cut the wires at the pulleys to complete the process.

It is contemplated that the embodiments disclosed may be used to dispense stranded material other than wire, such as rope, thread, bare metal cables, or any material that is supplied on spools and takes the form of a stranded material.

The disclosed embodiments include a distance measuring mechanism comprised of a rotational measurement device driven by a gear linkage mechanism coupled to a rotating axle, yet other distance measuring devices such as laser or light based measuring devices, and even a simple mechanical tape measure, are contemplated as reasonable substitutes for measurement of distance traversed while dispensing stranded material with the embodiments disclosed herein.

Another desirable mechanism for use with the embodiments disclosed herein is a wheel or tire locking mechanism to prevent rotation of the tires 22 and 80 when the mobile portions of the disclosed embodiments are at rest. Such well known caster or tire locking mechanisms serve to stabilize the mobile portion and are a contemplated feature for the embodiments of the disclosed invention.

Further, though the embodiments disclosed include a movable and a stationary portion, it follows that the stationary portion may be equipped with tires or the like so that both portions if the invention are readily movable. Tires and tire locking mechanisms for tires on both the stationary and the movable portion of the invention disclosed are contemplated to provide convenience in deploying the present invention to a worksite. While the invention has been illustrated and described in detail in the drawings and foregoing description of the preferred embodiment, the same is to be considered as illustrative and not restrictive in character, it being understood that only the preferred embodiment has been shown and described and that all changes and modifications that come within the spirit of the invention are desired to be protected.

What is claimed is:

1. A device for measuring and dispensing multiple elongated lengths of wire at a desired wire length from a single supply spool of wire, said device comprising:

a stationary member;

a first plurality of pulleys rotatably attached to said stationary member;

a supply spool rotatably attached to said stationary member, said supply spool having a wire wound thereon;

a mobile member;

a second plurality of pulleys rotatably attached to said mobile member;

and wherein said wire on said supply spool is looped once about each of said second plurality of pulleys on said mobile member, and once about each of said first plurality of pulleys on said stationary member in an alternating fashion in accordance with the number of elongated lengths of wire desired, and wherein said mobile member is displaced from said stationary member a distance equal to the desired wire length and said wires are cut from said first and second plurality of pulleys.

2. The device of claim 1 including a cylindrical member rotatably attached to said mobile member, and wherein said mobile member may be oriented to roll on said cylindrical member when said mobile member is moved from location to location.

3. The device of claim 2 including means for measuring distance, said means for measuring distance attached to said mobile member and mechanically engaging said cylindrical member to measure the number of revolutions of said cylindrical member, said means for measuring distance also including display means for providing a visual indication corresponding to the number of revolutions of said cylindrical member.

4. The device of claim 3 wherein said display means provides a visual indication corresponding to a standard measurement system.

5. The device of claim 4 wherein said cylindrical member is a tire.

6. The device of claim 5 wherein said stationary member is a stationary rectangular frame, said device further including a first rod spanning across said stationary rectangular frame on which said first plurality of pulleys and said supply spool are rotatably mounted.

7. The device of claim 6 wherein said mobile member is a mobile rectangular frame, said device also including a second rod spanning across said mobile rectangular frame on which said second plurality of pulleys is situated.

8. A method for dispensing and measuring a plurality of desired length wires from a single spool of wire, said method comprising the steps of:

providing a stationary member having a plurality of pulleys rotatably attached thereto and a wire wound about a supply spool rotatably mounted on said stationary member;

providing a mobile member having a plurality of pulleys rotatably attached thereto;

positioning said mobile member in near proximity to said stationary member;

dispensing a sufficient portion of said wire on said supply spool and looping said wire in an alternating fashion about one of said plurality of pulleys on said mobile member and then about one of said plurality of pulleys on said stationary member;

repeating the dispensing and looping step until a desired number of wires extends between said mobile member and said stationary member;

securing the free end of said wire to said mobile portion or said stationary portion, whichever is closest;

moving said mobile member a predetermined distance from said stationary member, said predetermined distance corresponding to the desired length of the wires; and cutting said wire near each of said plurality of pulleys.

9. The method of claim 8 wherein said mobile member includes distance measuring means for ascertaining the distance that said mobile member has been moved.

10. The method of claim 9 wherein each of said plurality of pulleys on said mobile member and on said stationary member are mounted on a rod.

11. The method of claim 9 wherein each of said plurality of pulleys on said mobile member and on said stationary member are rotatably mounted at the end of a short shaft so that a wire is readily looped about said pulley.

12. A device for measuring and dispensing multiple elongated lengths of wire at a desired wire length from a single supply spool of wire, said device comprising:

a movable support frame;

a first plurality of pulleys rotatably mounted on said movable support frame;

a stationary support frame;

a second plurality of pulleys rotatably mounted on said stationary support frame;

a supply spool having a wire wound thereon, said supply spool rotatably mounted on said stationary support frame; and wherein said wire is dispensed from said supply spool and looped, in an alternating fashion, once about each of said first plurality of pulleys and once about each of said second plurality of pulleys, and wherein said movable support frame is displaced from said stationary support frame a distance corresponding to the desired wire length.

13. The device of claim 12 wherein said movable support frame includes means for measuring displacement distances attached thereto, said means for measuring providing a visual indicator of the distance that said movable support frame has physically moved.

14. The device of claim 13 wherein said movable support frame includes an axle and at least two tires mounted on said axle, and said means for measuring includes an input shaft extending therefrom with a first gear mounted on said shaft, said device further including a second gear mounted on said axle and engaging said first gear, and wherein said means for measuring responds to rotation of said input shaft to provide said visual indicator of the distance said movable support frame is displaced.

15. The device of claim 14 wherein said stationary support frame includes a base, and first upright member, a second upright member and a rod extending between said first and said second upright members, and wherein said second plurality of pulleys are mounted on said rod.

16. The device of claim 15 wherein said movable support frame includes a rod mounted thereon, and wherein said first plurality of pulleys is rotatably mounted on said rod.

17. A device for measuring and dispensing multiple elongated lengths of stranded material at a desired length from a single stranded material supply spool having a continuous length of stranded material wound thereon, said device comprising:

a first member;

a first plurality of pulleys rotatably attached to said first member;

a supply spool rotatably attached to said first member, said supply spool having a wire wound thereon;

a second member;

a second plurality of pulleys rotatably attached to said second member;

and wherein said stranded material on said supply spool is looped once about each of said second plurality of pulleys on said second member, and once about each of said first plurality of pulleys on said first member in an alternating fashion in accordance with the number of elongated lengths of stranded material desired, and wherein said second member is displaced from said first member a distance equal to the desired strand length and said stranded material is severed at a location adjacent each of said first and said second plurality of pulleys where said stranded material is looped thereabout.

* * * * *